US012553294B2

(12) United States Patent
Atkins et al.

(10) Patent No.: US 12,553,294 B2
(45) Date of Patent: Feb. 17, 2026

(54) ENHANCED CHIP FLOW DRILL BIT CUTTER

(71) Applicant: Halliburton Energy Services, Inc., Houston, TX (US)

(72) Inventors: William Atkins, Conroe, TX (US); Douglas Bruce Caraway, Conroe, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/821,837

(22) Filed: Aug. 30, 2024

(65) Prior Publication Data

US 2025/0075563 A1 Mar. 6, 2025

Related U.S. Application Data

(60) Provisional application No. 63/535,958, filed on Aug. 31, 2023.

(51) Int. Cl.
*E21B 10/567* (2006.01)

(52) U.S. Cl.
CPC ..... *E21B 10/5673* (2013.01)

(58) Field of Classification Search
CPC ..... E21B 10/5673
See application file for complete search history.

(56) References Cited

U.S. PATENT DOCUMENTS

| | | | | |
|---|---|---|---|---|
| 4,984,642 | A * | 1/1991 | Renard | E21B 10/5673 175/430 |
| 10,399,206 | B1 | 9/2019 | Mortensen et al. | |
| 2006/0102389 | A1* | 5/2006 | Wiseman | E21B 10/5676 175/428 |
| 2019/0338599 | A1* | 11/2019 | Bellin | E21B 10/55 |
| 2020/0018122 | A1 | 1/2020 | Keller et al. | |
| 2022/0403706 | A1* | 12/2022 | Miess | E21B 10/5673 |

* cited by examiner

*Primary Examiner* — Matthew R Buck
(74) *Attorney, Agent, or Firm* — Michael Jenney; C. Tumey Law Group PLLC

(57) ABSTRACT

A cutting element may include a substrate securable within a pocket formed in a bit body of a drill bit and a cutting portion securable to the substrate. The cutting portion may have a cutting face with at least one axial edge surface extending circumferentially along a first portion of a periphery of the cutting face and extending radially inward from the periphery. The cutting face may also include a plurality of ridges. At least one ridge of the plurality of ridges may extend from a second portion of the periphery of the cutting face to a radially inner side of the at least one axial edge surface. Additionally, the cutting face may include at least one channel formed between adjacent ridges of the plurality of ridges. The at least one channel may be configured to direct formation cuttings along a path of the at least one channel.

20 Claims, 6 Drawing Sheets

ENHANCED CHIP FLOW DRILL BIT CUTTER

CROSS-REFERENCE TO RELATED APPLICATIONS

The present application is a non-provisional conversion of U.S. Provisional Application Ser. No. 63/535,958, filed on Aug. 31, 2023, which is herein incorporated by reference in its entirety.

BACKGROUND

Various types of tools are used to form wellbores in subterranean formations for recovering hydrocarbons such as oil and gas lying beneath the surface. Examples of such tools include rotary drill bits, hole openers, reamers, and coring bits. One common type of drill bit used to drill wellbores is known as a "fixed cutter" or "drag" bit. Rotary drill bits include fixed cutter drill bits, such as polycrystalline diamond ("PDC") cutters.

In conventional wellbore drilling, a drill bit is mounted on the end of a drill string, which may be several miles long. In practice, at the surface of the wellbore, a rotary table or top drive may turn the drill string, including the drill bit arranged at the bottom of the hole to increasingly penetrate the subterranean formation, while drilling fluid is pumped through the drill string. As the drill bit operates and comes into contact with the ground formation, material cut by the drill bit (generally referred to as cuttings, formation cuttings, or chips) is removed from the face of the drill bit and sent up the wellbore via drilling fluid.

On occasion, however, cuttings may become clogged in the system which may result in partial or full blockage of hydraulic operations. It follows that blockage may lead to delays in drilling operations while remedial measures are undertaken to remove the blockage. Such delays are often costly, time consuming, and hamper the efficiency of drilling operations.

BRIEF DESCRIPTION OF THE DRAWINGS

These drawings illustrate certain aspects of some of the embodiments of the present disclosure and should not be used to limit or define the method.

DETAILED DESCRIPTION

Provided are systems and methods for wellbore drilling and, more particularly, example embodiments may use of one or more cutting elements including a cutting face with one or more channels capable of steering chip cuttings into an intended direction off of the cutting face of the cutting element for drilling operations. As set forth in greater detail below, the one or more channels may have variable depths to help disrupt or suppress fracture paths such that the lifespan of the one or more cutting elements may be lengthened. Further, one or more ridges of the cutting face of the cutting element may only extend partially across the face of the cutting element, which may also help to disrupt or suppress fracture paths. Generally, fractured cutting elements generate additional vibrations while drilling, which may reduce the efficiency of drilling and result in the need for frequent replacement of drill bits and/or slower drilling rates. Accordingly, increasing the lifespan of the one or more cutting elements, as set forth above, may improve drilling efficiency and reduce operation costs.

Figure 1:
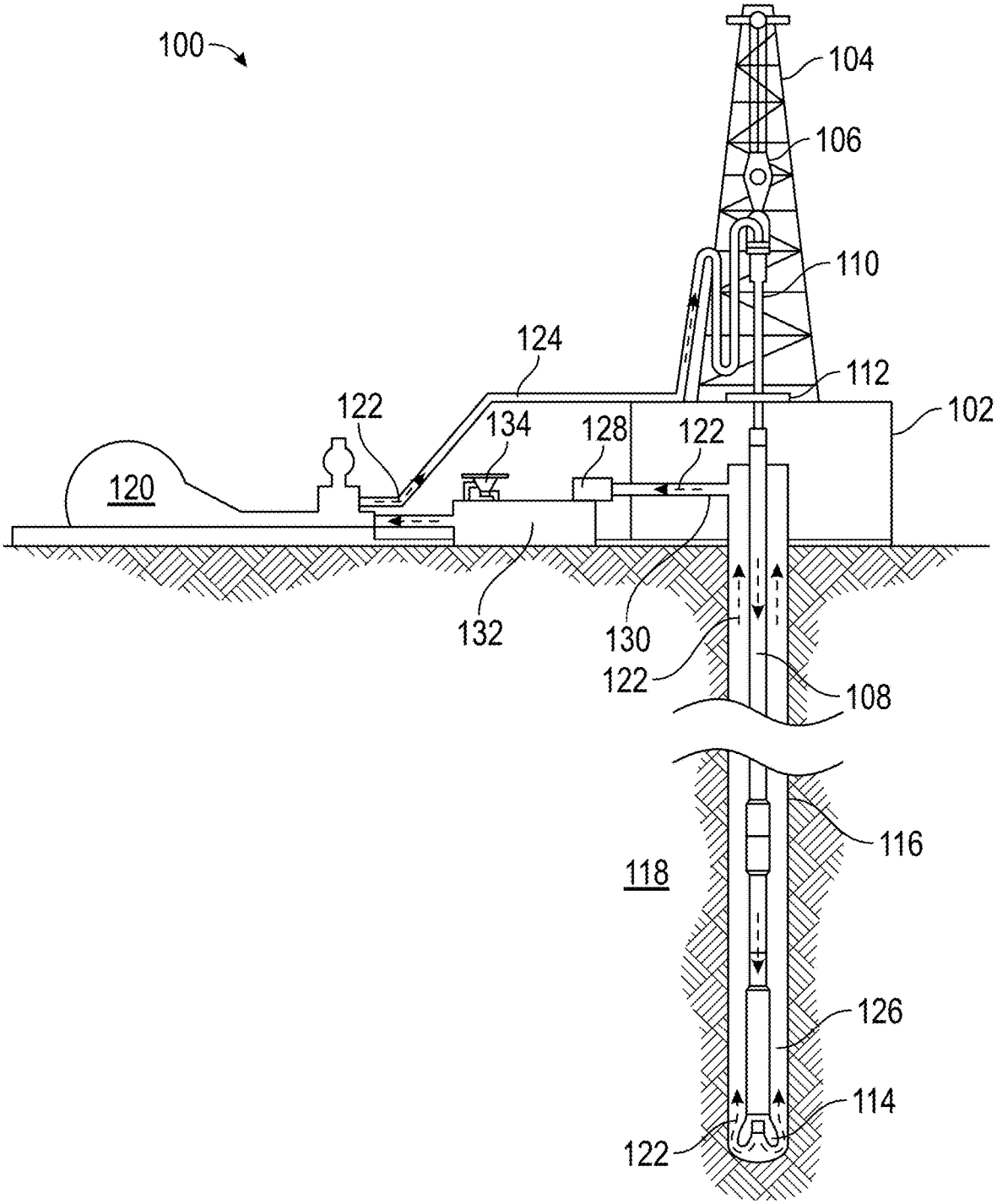
FIG. 1 illustrates a side elevation, partial cross sectional view of an operational environment in accordance with one or more embodiments of the disclosure.

FIG. 1 illustrates a side elevation, partial cross sectional view of an operational environment in accordance with one or more embodiments of the disclosure. It should be noted that while FIG. 1 generally depicts a land-based drilling assembly, those skilled in the art will readily recognize that the principles described herein are equally applicable to subsea drilling operations that employ floating or sea-based platforms and rigs, without departing from the scope of the disclosure. As illustrated, the drilling assembly 100 may include a drilling platform 102 that supports a derrick 104 having a traveling block 106 for raising and lowering a drill string 108. The drill string 108 may include, but is not limited to, drill pipe and coiled tubing, as generally known to those skilled in the art. A kelly 110 supports the drill string 108 as it is lowered through a rotary table 112. A drill bit 114 is attached to the distal end of the drill string 108 and is driven either by a downhole motor and/or via rotation of the drill string 108 from the well surface. As the drill bit 114 rotates, it creates a wellbore 116 that penetrates various subterranean formations 118.

The drill bit 114 may be a fixed-cutter bit. However, the drill bit 114 may include any suitable drill bit (e.g., a roller cone bit, a hybrid bit, etc.). The drill bit 114 may employ one or more cutting elements (shown in FIGS. 2-5). As set forth in greater detail below, the cutting elements may include one or features that facilitate flow of cuttings and other drilling debris away from the cutting elements. Further, while a drill bit 114 is shown, the drilling assembly may additionally be used to operate hole openers, reamers, and coring bits. Moreover, a pump 120 (e.g., a mud pump) circulates drilling fluid 122 through a feed pipe 124 and to the kelly 110, which conveys the drilling fluid 122 downhole through the interior of the drill string 108 and through one or more orifices in the drill bit 114. The drilling fluid 122 is then circulated back to the surface via an annulus 126 defined between the drill string 108 and the walls of the wellbore 116. At the surface, the recirculated or spent drilling fluid 122 exits the annulus 126 and may be conveyed to one or more fluid processing unit(s) 128 via an interconnecting flow line 130. After passing through the fluid processing unit(s) 128, a "cleaned" drilling fluid 122 is deposited into a nearby retention pit 132 (i.e., a mud pit). While illustrated as being arranged at the outlet of the wellbore 116 via the annulus 126, those skilled in the art will readily appreciate that the fluid processing unit(s) 128 may be arranged at any other location in the drilling assembly 100 to facilitate its proper function, without departing from the scope of the disclosure.

It is also to be recognized that the drilling fluids may also directly or indirectly affect the various downhole equipment and tools that may come into contact during operation. Such equipment and tools may include, but are not limited to, wellbore casing, wellbore liner, completion string, insert strings, drill string, coiled tubing, slickline, wireline, drill pipe, drill collars, mud motors, downhole motors and/or pumps, surface-mounted motors and/or pumps, centralizers, turbolizers, scratchers, floats (e.g., shoes, collars, valves, etc.), logging tools and related telemetry equipment, actuators (e.g., electromechanical devices, hydromechanical devices, etc.), sliding sleeves, production sleeves, plugs, screens, filters, flow control devices (e.g., inflow control devices, autonomous inflow control devices, outflow control devices, etc.), couplings (e.g., electro-hydraulic wet connect, dry connect, inductive coupler, etc.), control lines (e.g., electrical, fiber optic, hydraulic, etc.), surveillance lines, drill bits and reamers, sensors or distributed sensors, downhole heat exchangers, valves and corresponding actuation devices, tool seals, packers, cement plugs, bridge plugs, and other wellbore isolation devices, or components, and the like. Any of these components may be included in the systems generally described above and depicted in FIG. 1.

Figure 2:
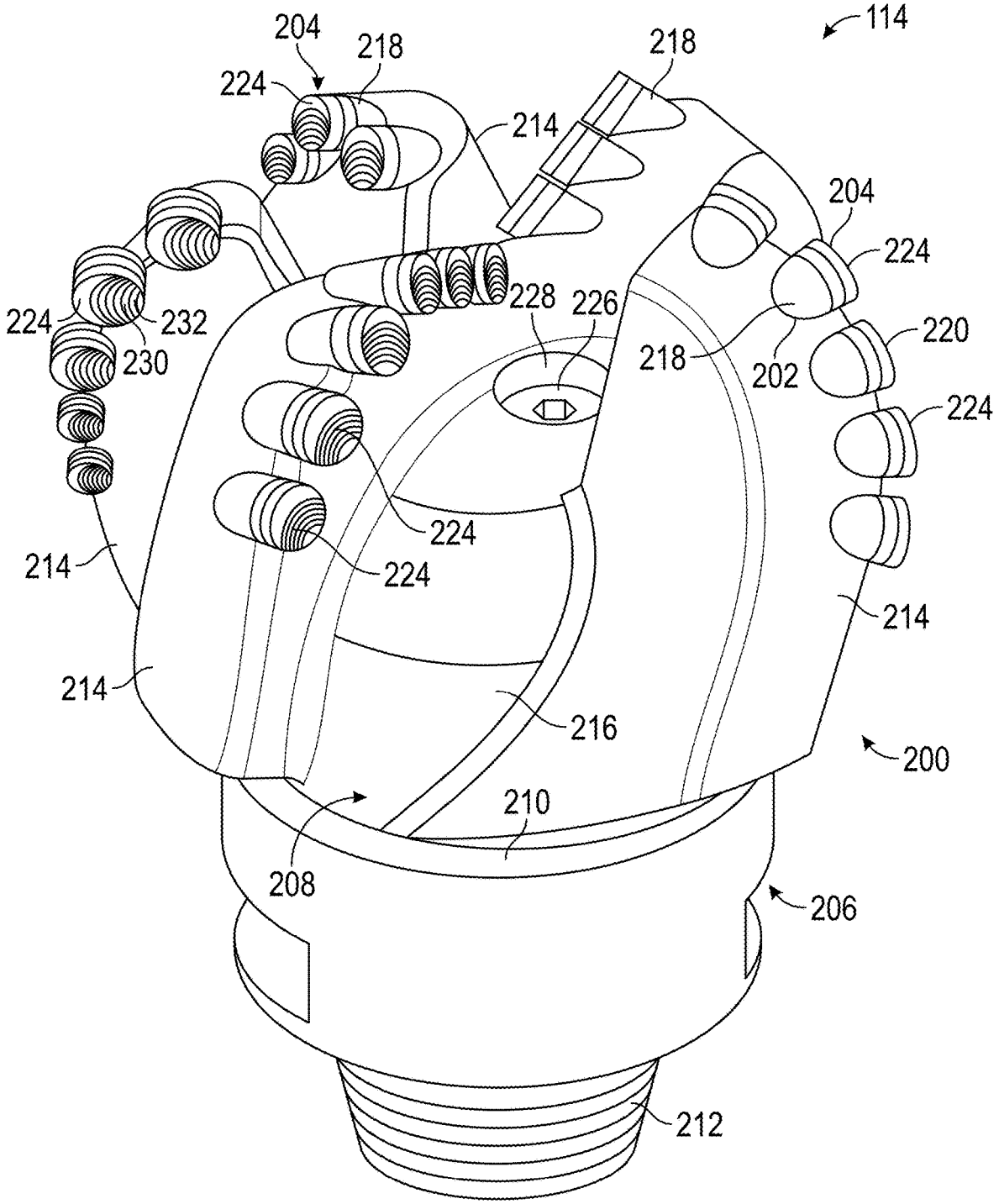
FIG. 2 illustrates a perspective view of a fixed-cutter drill bit having one or more cutting elements, in accordance with some embodiments of the present disclosure.

FIG. 2 illustrates a perspective view of a fixed-cutter drill bit having one or more cutting elements, in accordance with some embodiments of the present disclosure. The fixed-cutter drill bit 114 may have a bit body 200. In some embodiments, the bit body 200 may be formed by a metal-matrix composite (e.g., tungsten carbide reinforcing particles dispersed in a binder alloy). As used herein, the term "drill bit" encompasses rotary drag bits, drag bits, fixed-cutter drill bits, and any other drill bit having a bit body and capable of incorporating the teachings of the present disclosure. A plurality of indentations or pockets 202 are formed in the bit body 200 and are shaped or otherwise configured to receive corresponding cutting elements 204 as described herein. As illustrated, the bit body 200 includes a plurality of cutting elements 204. The cutting elements 204 may be the same as or similar to the cutting element 204 of FIG. 3A. It will be appreciated that cutting element 204 may be comprised of any number of suitable materials including a PDC composition.

Moreover, the drill bit 114 may include a metal shank 206 with a mandrel or metal blank 208 securely attached thereto (e.g., at weld location 210). The metal blank 208 extends into bit body 200. The metal shank 206 includes a threaded connection 212 distal to the metal blank 208. The bit body 200 may include a plurality of cutter blades 214 formed on the exterior of the bit body 200. Further, the cutter blades 214 may be spaced from each other on the exterior of the bit body 200 to form fluid flow paths or junk slots 216 therebetween.

As illustrated, the plurality of pockets 202 may be formed in the cutter blades 214 in predetermined positions. The cutting elements 204 may each be securely mounted (e.g., via brazing) in corresponding pockets 202 to engage and remove portions of a subterranean formation during drilling operations. In particular, the cutting elements 204 may each include a corresponding substrate 218 and cutting portion 220 securable to the substrate 218. The substrate 218 may be secured within the corresponding pocket 202. Further, the cutting portion 220 may include a cutting face 224 configured to engage and remove portions of a subterranean formation 118 during drilling operations. That is, the respective cutting face 224 of each cutting element 204 may be configured to scrape and gouge the subterranean formation 118 from the bottom and sides of a wellbore during rotation of the drill bit 114 by an attached drill string. A nozzle 226 may be positioned in each nozzle opening 228 and positioned to clear cuttings/chips of formation material from cutting elements 204 through evacuation features of the bit 114, including junk slots 216. The bit body 200 may further include a plurality of cutter blades 214 that are separated by the junk slots 216. As the drill bit 114 operates and comes into contact with the ground formation, cuttings are removed from the face of the drill bit 114 and sent up the wellbore via drilling fluid. However, as set forth above, cuttings may generally become clogged in the system which may result in partial or full blockage of hydraulic operations.

Accordingly, during drilling operations, cuttings may be directed toward higher fluid velocities, via the plurality of cutting elements, to accelerate cuttings removal. Generally, the center of the bit 114 may experience low fluid velocities which may cause poor cutting removal. Accordingly, each cutting element 204 may include one or more features that facilitate cutting removal by directing cuttings toward the annulus of the wellbore. For example, the respective cutting face 224 of each cutting element 204 may include at least one channel 230, formed between corresponding ridges of a plurality of ridges 232, to circulate the cuttings along a path of the at least one channel 230 in a direction toward the annulus 126 (shown in FIG. 1). As the annulus 126 may have higher fluid velocities than the center of the drill bit 114, directing the cuttings toward the annulus 126 may increase efficiency of cutting removal. Further, having the plurality of ridges 232 on the cutting element 204 may reduce the size of the cuttings. As smaller cuttings are easier to circulate toward the annulus 126 than larger cuttings, having the plurality of ridges 232 may also increase efficiency of cutting removal.

Figure 3A:
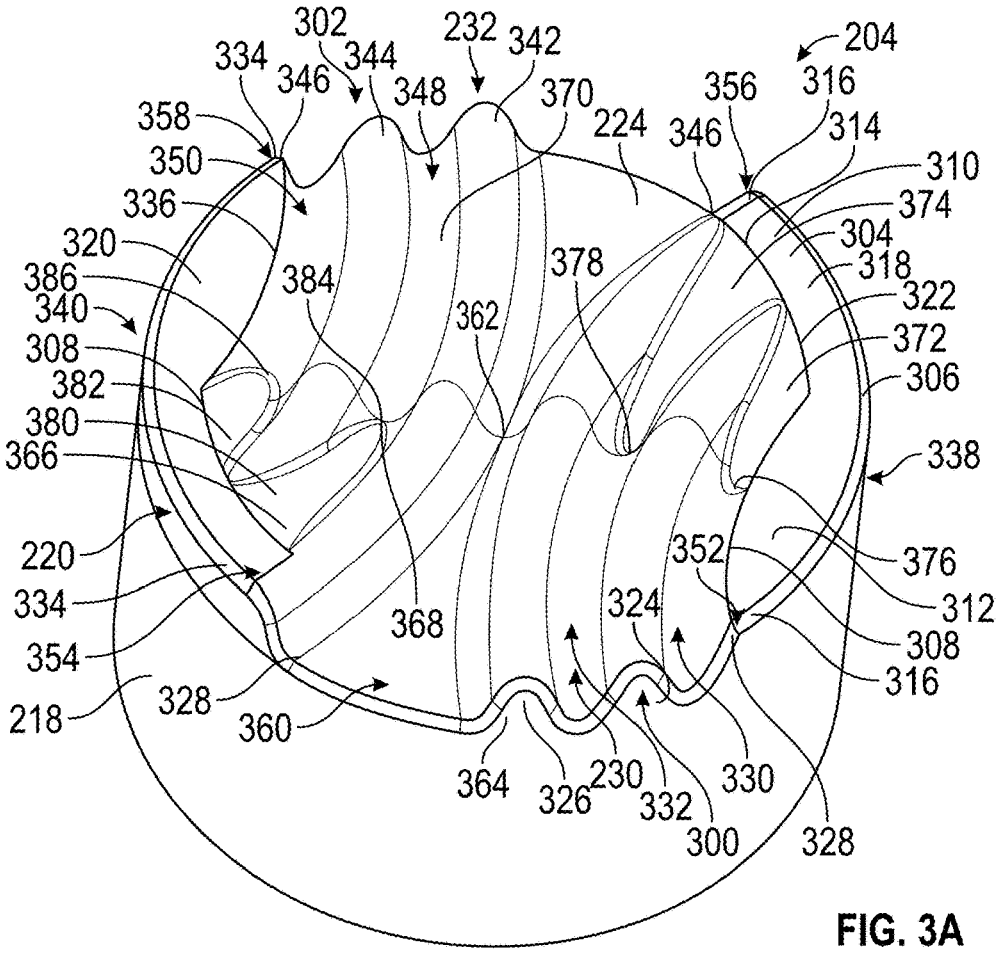
FIGS. 3A & 3B illustrate respective perspective and top views of a cutting element having a plurality of ridges, in accordance with some embodiments of the present disclosure.
Figure 3B:
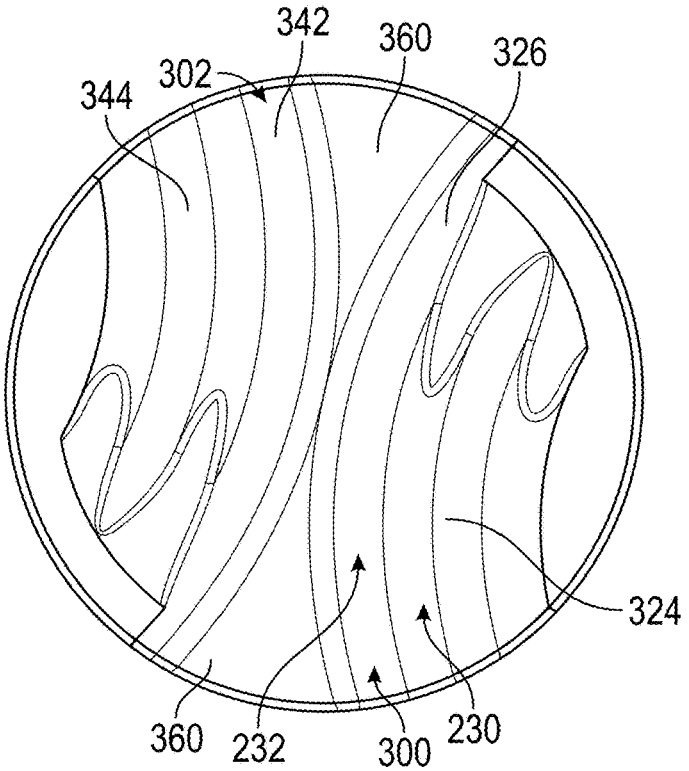

FIGS. 3A & 3B illustrate respective perspective and top views of a cutting element having a plurality of ridges, in accordance with some embodiments of the present disclosure. In particular, FIG. 3A illustrates a perspective view of the cutting element 204 having a first group of ridges 300 and a second group of ridges 302 formed on the cutting face 224 of the cutting element 204. As illustrated, the cutting element 204 may include the substrate 218 (e.g., a cylindrical tungsten carbide substrate) and the cutting portion 220 (e.g., polycrystalline diamond) secured to an axial end of the cylindrical substrate 218. The cutting face 224 may include an outer surface of the cutting portion 220. Moreover, the cutting face 224 may include the plurality of ridges 232 (e.g., the first group of ridges 300 and the second group of ridges 302) with the at least one channel 230 formed between adjacent ridges and/or at least one axial edge surface 304 of the cutting face 224. Any suitable technique may be used to form the ridges 232 and the at least one channel 230 in the cutting face 224. For example, the ridges 232 and the at least one channel 230 may be formed during a high pressure/high temperature process or via removal of material from cutting portion following a high pressure/high temperature formation process. Further, suitable processes for removing material from the cutting face 224 include grinding, electrical discharge machining, and laser ablation.

During drilling operations, the ridges 232 and the at least one channel 230 may circulate cuttings (e.g., chips or ribbons of the subterranean formation) toward a preferred destination (e.g., the junk slots 216 of the drill bit 114 shown in FIG. 2), which may increase efficiency of cutting removal. That is, the cuttings may flow through the at least one channel 230 such that the path of the channel 230 may direct flow of the cuttings. Further, as set forth above, directing the cuttings away from the drill bit 114 and toward the one or more junk slots 216 in a directed manner, via the at least one channel 230, may increase drilling efficiency and reduce the likelihood of clogs.

The cutting face 224 may also include the at least one axial edge surface 304 that extends circumferentially along a corresponding portion of a periphery 306 of the cutting face 224 and extends radially inward from the corresponding portion of the periphery 306. The periphery 306 may include a chamfered edge. Alternatively, only a portion of the periphery 306 may be chamfered, or the periphery 306 may not include a chamfered edge. Additionally, the chamfered edge may include variable chamfer. Moreover, the at least one axial edge surface 304 may extend radially inward from the periphery 306 to a radially inner side 308 of the at least one axial edge surface 304. Further, as illustrated, the at least one axial edge surface 304 may include a uniform radial width portion 310 and a non-uniform radial width portion 312. The uniform radial width portion 310 may extend radially inward from the periphery 306 to a parallel portion 314 of the radially inner side 308 of the at least one axial edge surface 304. The parallel portion 314 may include a portion of the radially inner side 308 that is parallel to a first portion 316 of the periphery 306. The non-uniform radial width portion 312 of the radially inner side 308 may be curved. For example, as illustrated, the non-uniform radial width portion 312 may extend along a curved path parallel to a ridge disposed adjacent the at least one axial edge surface 304. Further, the at least one axial edge surface 304 may only extend partially along the circumference of the cutting face 224. However, the at least one axial edge surface 304 may alternatively extend along the entire circumference of the cutting face 224. Additionally, as illustrated, the cutting element 204 may include a plurality of axial edge surfaces.

For example, as illustrated, the cutting face 224 may include a first axial edge surface 318 and a second axial edge surface 320. However, the cutting face 224 may include any suitable number of axial edge surfaces. The first axial edge surface 318 may extend circumferentially along a first portion of the periphery 306 of the cutting face 224 and extend radially inward from the first portion 316 of the periphery 306 to a first radially inner side 322 of the first axial edge surface 318. Further, as set forth above, the cutting face 224 may include the first group of ridges 300. As illustrated, the first group of ridges 300 may include a first ridge 324 and a second ridge 326. However, the first group of ridges 300 may include any suitable number of ridges. Each of the first ridge 324 and the second ridge 326 may extend across the cutting face 224 from a second portion 328 of the periphery 306 to the first radially inner side 322 of the first axial edge surface 318. Having the first ridge 324 and the second ridge 326 only extend across a portion of the cutting face 224 (e.g., from the second portion 328 of the periphery 306 to the first radially inner side 322) instead of extending from the second portion 328 of the periphery 306 to the first portion 316 of the periphery 306 help suppress fracture formation in the plurality of ridges 232. That is, the first axial edge surface 318 being positioned between respective ends first group of ridges 300 and the first portion 316 of the periphery 306 may help support the plurality of ridges 232 and suppress fracture formation in the plurality of ridges 232. Moreover, as illustrated, each ridge of the first group of ridges 300 may extend parallel with each other. That is, the first ridge 324 may be parallel to the second ridge 326. Further, a first channel 330 may be formed between the first radially inner side 322 of the first axial edge surface 318 and the first ridge 324. A second channel 332 may be formed between the first ridge 324 and the second ridge 326.

The second axial edge surface 320 may extend circumferentially along a third portion 334 of the periphery 306 of the cutting face 224 and extend radially inward from the third portion 334 of the periphery 306 to a second radially inner side 336 of the second axial edge surface 320. The second axial edge surface 320 may be coplanar with the first axial edge surface 318. Alternatively, the second axial edge surface 320 may be axially offset from the first axial edge surface 318 with respect to the substrate 218. Moreover, as illustrated, the second axial edge surface 320 may be disposed on an opposite side of the cutting face 224 with respect to the first axial edge surface 318. For example, the first axial edge surface 318 may extend radially inward from a first side 338 of the cutting face 224 and the second axial edge surface 320 may extend radially inward from a second side 340 of the cutting face 224.

Further, as set forth above, the cutting face 224 may include the second group of ridges 302. As illustrated, the second group of ridges 302 may include a third ridge 342 and a fourth ridge 344. However, the second group of ridges 302 may include any suitable number of ridges. The third ridge 342 and the fourth ridge 344 may each extend across the cutting face 224 from a fourth portion 346 of the periphery 306 to the second radially inner side 336 of the second axial edge surface 320. As illustrated, each ridge of the second group of ridges 302 may extend parallel with each other. That is, the third ridge 342 may be parallel to the fourth ridge 344. Further, the ridges of the first group of ridges 300 may be nonparallel with the ridges of the second group of ridges 302. Moreover, a third channel 348 may be formed between the third ridge 342 and the fourth ridge 344, and a fourth channel 350 may be formed between the fourth ridge 344 and the second radially inner side 336 of the second axial edge surface 320.

Figure 4:
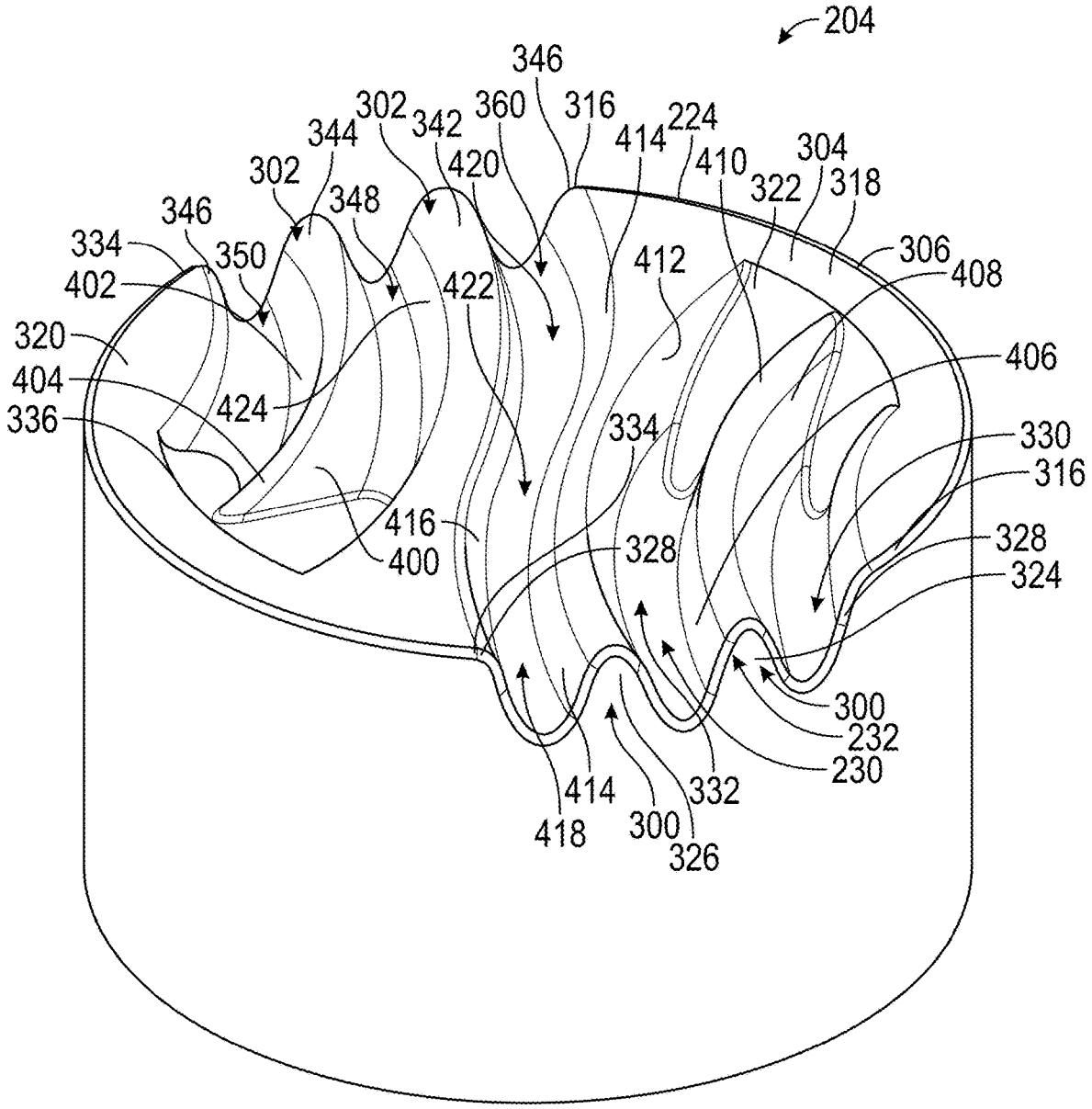
FIG. 4 illustrates a perspective view of a cutting element having a curved central channel with an inflection point, in accordance with some embodiments of the present disclosure.

The second portion 328 of the periphery 306 may extend between a first circumferential end 352 of the first axial edge surface 318 and a second circumferential end 354 of the second axial edge surface 320. Additionally, the fourth portion 346 of the periphery 306 may extend between a third circumferential end 356 of the first axial edge surface 318 and a fourth circumferential end 358 of the second axial edge surface 320. Moreover, the cutting face 224 may include a central channel 360 formed between the first group of ridges 300 and the second group of ridges 302. The central channel 360 may extend across the cutting face 224 from the second portion 328 of the periphery 306 to the fourth portion 346 of the periphery 306 disposed opposite the second portion 328. Further, the central channel 360 may include a variable width (e.g., variable central channel width) along the length of the central channel 360. For example, as illustrated, the variable central channel width may decrease in a radially inward direction with respect to the periphery 306 of the cutting face 224. The width of the central channel 360 may continuously decrease from the respective portions of the periphery 306 (e.g. the second portion 328 and the fourth portion 346) of the cutting face 224 in the direction toward a center 362 of the cutting face 224. Alternatively, as shown in FIG. 4, the central channel 360 may include a uniform central channel width along the length of the central channel 360. Moreover, the central channel 360 may include a variable depth along the length of the central channel 360.

Moreover, at least one ridge 364 (e.g., the first ridge 324) of the plurality of ridges 232 may include a variable width along a height of the at least one ridge 364 such that a cross-sectional shape of the at least one ridge 364 may be curved. That is, the cross-sectional shape of the at least one ridge 364 may be substantially parabolic. As such, the width of the at least one channel 230 formed between adjacent ridges of the plurality of ridges 232 may vary along the depth of the at least one channel 230. For example, the at least one channel 230 may have converging sidewalls from the curved shape of the adjacent ridges such that the cross-sectional shape of the at least one channel 230 may be generally parabolic. Alternatively, the at least one channel 230 also may have a width that is substantially constant (i.e., uniform) along the depth of the at least one channel 230. That is, the at least one channel 230 may have substantially parallel channel sidewalls such that a cross-sectional shape of at least one channel 230 may be generally rectangular in response to the cutting face 224 having rectangularly shaped ridges.

Moreover, as set forth above, the first axial edge surface 318 and the second axial edge surface 320 may be coplanar. As such, the first axial edge surface 318 may be axially aligned with the second axial edge surface 320. As illustrated, the plurality of ridges 232 may also be axially aligned with the first axial edge surface 318 and the second axial edge surface 320. In particular, respective peaks of each ridge of the plurality of ridges 232 may be axially aligned with the first axial edge surface 318 and the second axial edge surface 320. That is, as illustrated, the respective peaks of the first ridge 324, the second ridge 326, the third ridge 342 and the fourth ridge 344 may be axially aligned with the first axial edge surface 318 and the second axial edge surface 320.

The plurality of ridges 232 and the at least one channel 230 formed between adjacent ridges of the plurality of ridges 232 may be curved. For example, as illustrated, the first ridge 324 and the second ridge 326 of the plurality of ridges 232 may extend across the cutting face 224 along a curved path. As such, the second channel 332 formed between the first ridge 324 and the second ridge 326 may also extend across the cutting face 224 along a curved path. Further, the plurality of ridges 232 and the at least one channel 230 may be arc or ring shaped. However, the at least one channel 230 may alternatively be defined by other shapes or partial shapes such as ellipsoids (e.g., tri-axial ellipsoids, oblate ellipsoids, prolate ellipsoids, and spheres), ovals, cassini ovals, s-shaped, or some combination thereof. The shape of the at least one channel 230 may be elected based at least in part on the type of rock to be drilled. For example, if the drill bit 114 is configured to drill a relatively a soft formation, the at least one channel 230 may include one or more shapes with smaller radii than a channel for a drill bit 114 configured to drill a relatively hard formation.

Moreover, the at least one channel 230 (e.g., the first channel 330, the second channel 332, the third channel 348, the fourth channel 350) may include a tapered section 366 that extends from an initial point 368 along the length of the at least one channel 230 to the radially inner side 308 of the at least one axial edge surface 304. The initial point 368 may be at a transition between a main portion 370 of the at least one channel 230 and the tapered section 366 of the at least one channel 230. The depth of the tapered section 366 may generally reduce in the direction from the initial point 368 toward the radially inner side 308 of the at least one axial edge surface 304. That is, the tapered section 366 of the at least one channel 230 may become shallower as the tapered section 366 approaches the radially inner side 308 of the at least one axial edge surface 304. Further, an end of the tapered section 366 may extend to the top of the radially inner side 308 such that the end of the tapered section 366 may be axially aligned with the at least one axial edge surface 304.

Additionally, the tapered section 366 may extend linearly from the initial point 368 to the radially inner side 308 of the at least one axial edge surface 304. That is, the depth of the tapered section 366 may reduce linearly from the initial point 368 to the radially inner side 308 of the at least one axial edge surface 304. Alternatively, the tapered section 366 may extend non-linearly from the initial point 368 to the radially inner side 308 of the at least one axial edge surface 304. The tapered section 366 may operate as a ramp to guide the cuttings in the at least one channel 230 up the tapered section 366 and over the at least one axial edge surface 304. As illustrated, the first channel 330 and the second channel 332 may include a first tapered section 372 and a second tapered section 374, respectively, extending from respective initial points (e.g., a first initial point 376 and a second initial point 378) along the corresponding lengths of the first channel 330 and the second channel 332 to the first radially inner side 322 of the first axial edge surface 318. Additionally, the third channel 348 and the fourth channel 350 may include a third tapered section 380 and a fourth tapered section 382, respectively, extending from respective initial points (e.g., a third initial point 384 and a fourth initial point 386) along the corresponding lengths of the third channel 348 and the fourth channel 350 to the second radially inner side 336 of the second axial edge surface 320.

Further, as illustrated, the main portion 370 of the at least one channel 230 may include a uniform depth along the length of the main portion 370 of the at least one channel 230. Alternatively, the main portion 370 may have a non-uniform depth. That is, the depth of the of the main portion 370 may increase and/or decrease along the length of the main portion 370 of the at least one channel 230. The depth of the at least one channel 230 may be related to various materials used to form the cutting element 204. Moreover, as set forth above, the at least one channel 230 may include a plurality of channels (e.g., the first channel 330, the second channel 332, the third channel 348, the fourth channel 350, the central channel 360). At least one channel of the plurality of channels 230 may have a different depth, relative to the cutting face 224, than other channels of the plurality of channels 230. For example, the depth of the first channel 330 may be shallower than the depth of the second channel 332.

Moreover, the plurality of channels 230 may be spaced apart on the cutting face 224 at a uniform distance such that the plurality of channels 230 may maintain a uniform, or consistent width apart. For example, as illustrated, the first channel 330 and the second channel 332 formed by the first group of ridges 300 may be spaced uniformly apart and the third channel 348 and the fourth channel 350 formed by the second group of ridges 302 may be spaced uniformly apart. Alternatively, the channels corresponding to the first group of ridges 300 and the channels corresponding to the second group of ridges 302 may not be spaced uniformly apart. That is, the width and distance of the spacing between the plurality of channels 230 may converge, diverge, and or taper.

The term channel, as used herein, in describing the plurality of channels 230, may be used interchangeably with the term groove. Other aspects of the channels, the ridges, and the cutting face, according to the present disclosure, include polishing on one or more surfaces but not on other surfaces to reduce, or increase, friction to suit a particular use. The plurality of channels 230 may also include alternative cross-sectional profile shapes such as slots, bumps, treads, castellating ridges, and planar, semi-planar, or non-planar shapes.

FIG. 3B illustrates a top view of the cutting face of the cutting element. As set forth above, the cutting face may have at least one channel formed between adjacent ridges of the plurality of ridges on the cutting face. The at least one channel 230 may be configured to circulate cuttings (e.g., chips or ribbons of the subterranean formation 118 shown in FIG. 1) toward a preferred destination (e.g., the junk slots 216 of the drill bit 114 shown in FIG. 2), which may increase efficiency of cutting removal and reduce the likelihood of clogs.

The plurality of ridges 232 may include the first group of ridges 300 having the first ridge 324 and the second ridge 326 as well as the second group of ridges 302 having the third ridge 342 and the fourth ridge 344. Further, as set forth above, each ridge of the plurality of ridges 232 may be curved. Additionally, each ridge of the plurality of ridges 232 may be curved with one or more inflection points along respective lengths of each ridge. For example, each ridge may include an inflection point such that each ridge includes an "s" shaped curve. Moreover, as illustrated, the first ridge 324 and the second ridge 326 may have substantially similar curvature such that the width between the ridges 232 is uniform or consistent along respective lengths of the ridges. Similarly, the third ridge 342 and the fourth ridge 344 may have substantially similar curvature such that the width between the ridges is uniform or consistent along respective lengths of the ridges. However, the ridges of the first group of ridges 300 and the ridges of the second group of ridges 302 may not be spaced uniformly apart. Further, the respective curvatures of the first group of ridges 300 may be symmetrical with the second group of ridges 302 about the central channel 360 extending across the cutting face 224.

FIG. 4 illustrates a perspective view of a cutting element having a curved central channel with an inflection point, in accordance with some embodiments of the present disclosure. As set forth above, the cutting face 224 of the cutting element 204 may include the plurality of ridges 232 with the at least one channel 230 formed between adjacent ridges 232 and/or axial edge surfaces 304 of the cutting face 224. For example, as illustrated, the cutting face 224 may include the first axial edge surface 318 extending circumferentially along the first portion 316 of the periphery 306 of the cutting face 224 and extending radially inward from the first portion 316 of the periphery 306 to the first radially inner side 322 of the first axial edge surface 318. Further, as set forth above, the cutting face 224 may include the first group of ridges 300 (e.g., the first ridge 324 and the second ridge 326) extending along curved paths across the cutting face 224 from the second portion 328 of the periphery 306 to the first radially inner side 322 of the first axial edge surface 318. Further, the first channel 330 may be formed between the first radially inner side 322 of the first axial edge surface 318 and the first ridge 324, and the second channel 332 may be formed between the first ridge 324 and the second ridge 326. The second channel 332 may be substantially parallel to the first channel 330.

Moreover, the second axial edge surface 320 of the cutting face 224 may extend circumferentially along the third portion 334 of the periphery 306 of the cutting face 224 and extend radially inward from the third portion 334 of the periphery 306 to the second radially inner side 336 of the second axial edge surface 320. The second group of ridges 302 (e.g., the third ridge 342 and the fourth ridge 344) may each extend along curved paths across the cutting face 224 from the fourth portion 346 of the periphery 306 to the second radially inner side 336 of the second axial edge surface 320. The third channel 348 may be formed between the third ridge 342 and the fourth ridge 344, and the fourth channel 350 may be formed between the fourth ridge 344 and the second radially inner side 336 of the second axial edge surface 320. The third channel 348 may be substantially parallel to the fourth channel 350.

Each ridge of the plurality of ridges 232 includes an inner ridge side 400, an outer ridge side 402, and a ridge peak 404 disposed at an apex of the inner ridge side 400 and the outer ridge side 402. For example, the first ridge 324 may include a first inner ridge side 406, a first outer ridge side 408, and a first ridge peak 410. The first ridge peak 410 may extend along the length of the first ridge 324. That is, each of the first ridge peak 410, the first inner ridge side 406, and the first outer ridge side 408, may extend from the second portion 328 of the periphery 306 to the first radially inner side 322 of the first axial edge surface 318. Further, a second outer ridge side 412 of the second ridge 326 may extend from the second portion 328 of the periphery 306 to the first radially inner side 322. However, at least a portion of the second ridge 326 may extend from the second portion 328 of the periphery 306 to the fourth portion 346 of the periphery 306. In particular, as illustrated, a second inner ridge side 414 of the second ridge 326 may extend across the cutting face 224 from the second portion 328 of the periphery 306 to the fourth portion 346 of the periphery 306. Similarly, a third inner ridge side 416 of the third ridge 342 may extend across the cutting face 224 from the fourth portion 346 of the periphery 306 to the second portion 328 of the periphery 306.

The central channel 360 may be formed between the second inner ridge side 414 of the second ridge 326 and the third inner ridge side 416 of the third ridge 342. As both the second inner ridge side 414 and the third inner ridge side 416 extend between the second portion 328 of the periphery 306 and the fourth portion 346 of the periphery 306, the central channel 360 may extend across the cutting face 224 from the second portion 328 of the periphery 306 to the fourth portion 346 of the periphery 306 disposed opposite the second portion 328. Further, the second inner ridge side 414 and the third inner ridge side 416 may be uniformly offset (e.g., parallel) such that the width of the central channel 360 may be uniform along the length of the central channel 360. Additionally, the second inner ridge side 414 and the third inner ridge side 416 may extend along respective curved paths across the cutting face 224 such that the central channel 360 may be curved. In particular, the central channel 360 may be curved in a first direction along a first length 418 of the central channel 360 and curved in a second direction along a second length 420 of the central channel 360. That is, the central channel 360 may have an inflection point 422 proximate the center 362 of the cutting face 224. Alternatively, the inflection point 422 may be positioned at any suitable location along the central channel 360, and the central channel 360 may include a plurality of inflection points.

As illustrated, the second inner ridge side 414 and the third inner ridge side 416 may be curved to form the central channel 360 having the inflection point 422 proximate the center 362 of the cutting face 224. However, the respective outer ridge sides (e.g., a second outer ridge side 412 and a third outer ridge side 424) of the second ridge 326 and the third ridge 342 may only be curved in a single direction. Further, as illustrated, the first ridge 324 and the fourth ridge 344 may only be curved in a single direction. Alternatively, each of the ridges of the plurality of ridges 232 may include any suitable number of inflection points along the respective lengths of the ridges. Further, as set forth above, the plurality of ridges 232 and the at least one channel 230 may be arc or ring shaped. However, the at least one channel 230 may alternatively be defined by other shapes or partial shapes such as ellipsoids, ovals, cassini ovals, s-shaped, or some combination thereof. The shape of at least one channel 230 may be formed based at least in part on the type of rock to be drilled. For example, if the drill bit 114 (shown in FIG. 2) is configured to drill a relatively a soft formation, the at least one channel 230 may include one or more shapes with smaller radii than a channel for a drill bit configured to drill a relatively hard formation.

Figure 5:
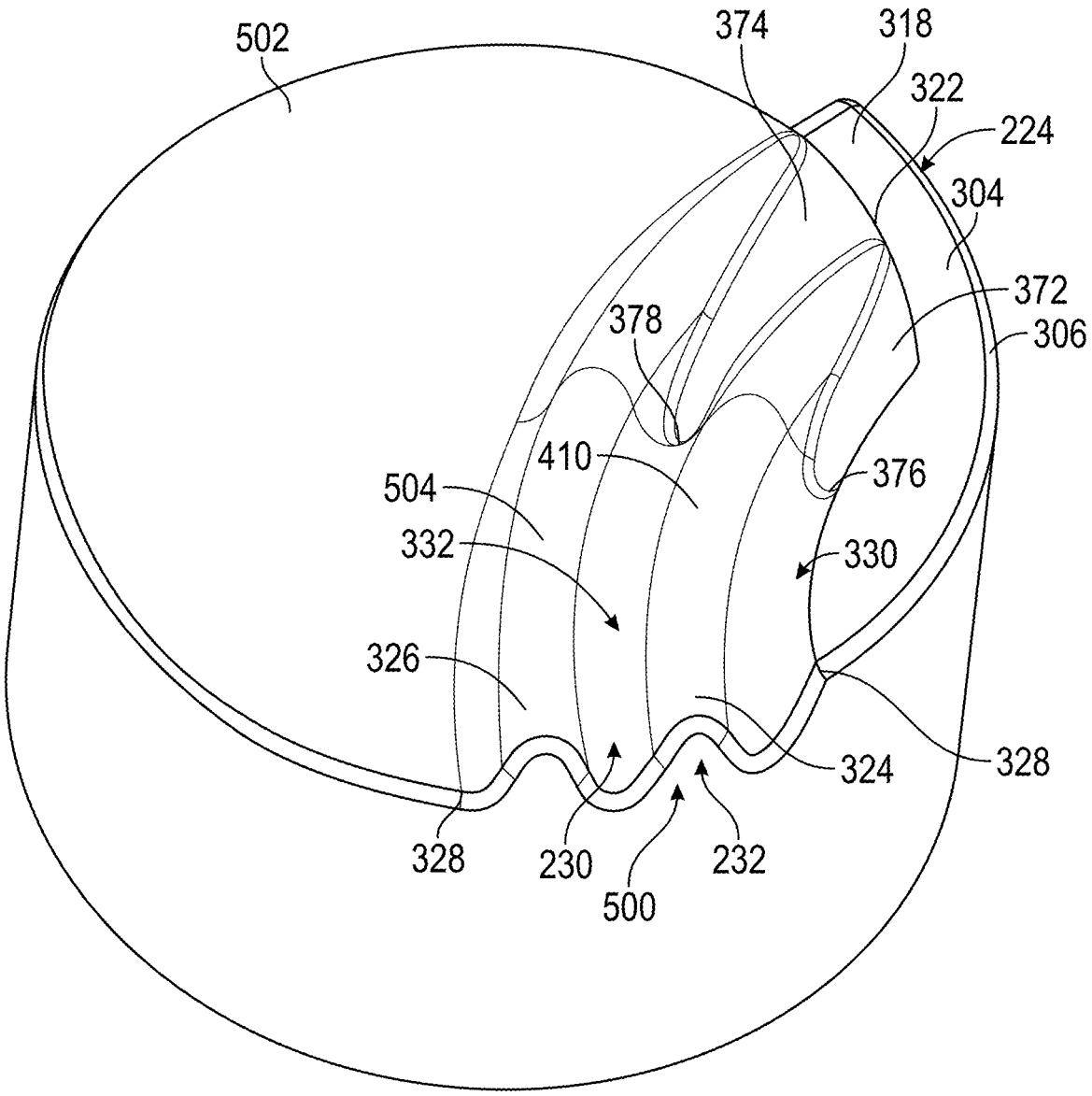
FIG. 5 illustrates a top view of a cutting element having a flat section and a channeled section, in accordance with some embodiments of the present disclosure.

FIG. 5 illustrates a top view of a cutting element having a flat section and a channeled section, in accordance with some embodiments of the present disclosure. The channeled section 500 may include the plurality of ridges 232 and the at least one channel 230 formed in the cutting face 224. As illustrated, the plurality of ridges (e.g., the first ridge 324 and the second ridge 326) may extend across the cutting face 224 from the second portion 328 of the periphery 306 to the first radially inner side 322 of the first axial edge surface 318. Further, the first channel 330 may be formed between the first radially inner side 322 and the first ridge 324, and the second channel 332 may be formed between the first ridge 324 and the second ridge 326. Moreover, the first channel 330 and the second channel 332 may include corresponding tapered sections (e.g., a first tapered section 372 and a second tapered section 374) that extend from respective initial points (e.g., a first initial point 376 and a second initial point 378) along the corresponding lengths of the first channel 330 and the second channel 332 to the first radially inner side 322 of the first axial edge surface 318. As set forth above, the depth of the respective tapered sections may generally reduce in the direction from the corresponding first initial point 376 and the second initial point 378 toward the radially inner side 308 of the at least one axial edge surface 304. As such, the first tapered section 372 and the second tapered section 374 may each become shallower as the respective tapered sections approach the first radially inner side 322 of the first axial edge surface 318.

Moreover, the cutting face 224 may further include the flat section 502. The flat section 502 may include a substantially flat axial surface of the cutting face 224 disposed on an opposite side of the cutting face 224 with respect to the first axial edge surface 318. The flat section 502 may be disposed axially inward with respect to respective ridge peaks (e.g., the first ridge peak 410 and a second ridge peak 504) of the first ridge 324 and the second ridge 326. Alternatively, the flat section 502 may be axially aligned with at least one ridge peak of the first ridge 324 and second ridge 326 and/or with the first axial edge surface 318. However, the flat section 502 may also be disposed axially outward with respect to the first ridge peak 410, the second ridge peak 504, the first axial edge surface 318, or some combination thereof. Although the flat section 502 may not be configured to direct cutting toward the junk slots or other preferred destination, the flat section 502 may be less susceptible to fracturing than the ridges of the plurality of ridges 232, which may increase the lifespan of the cutting element 204 under certain conditions.

Figure 6:
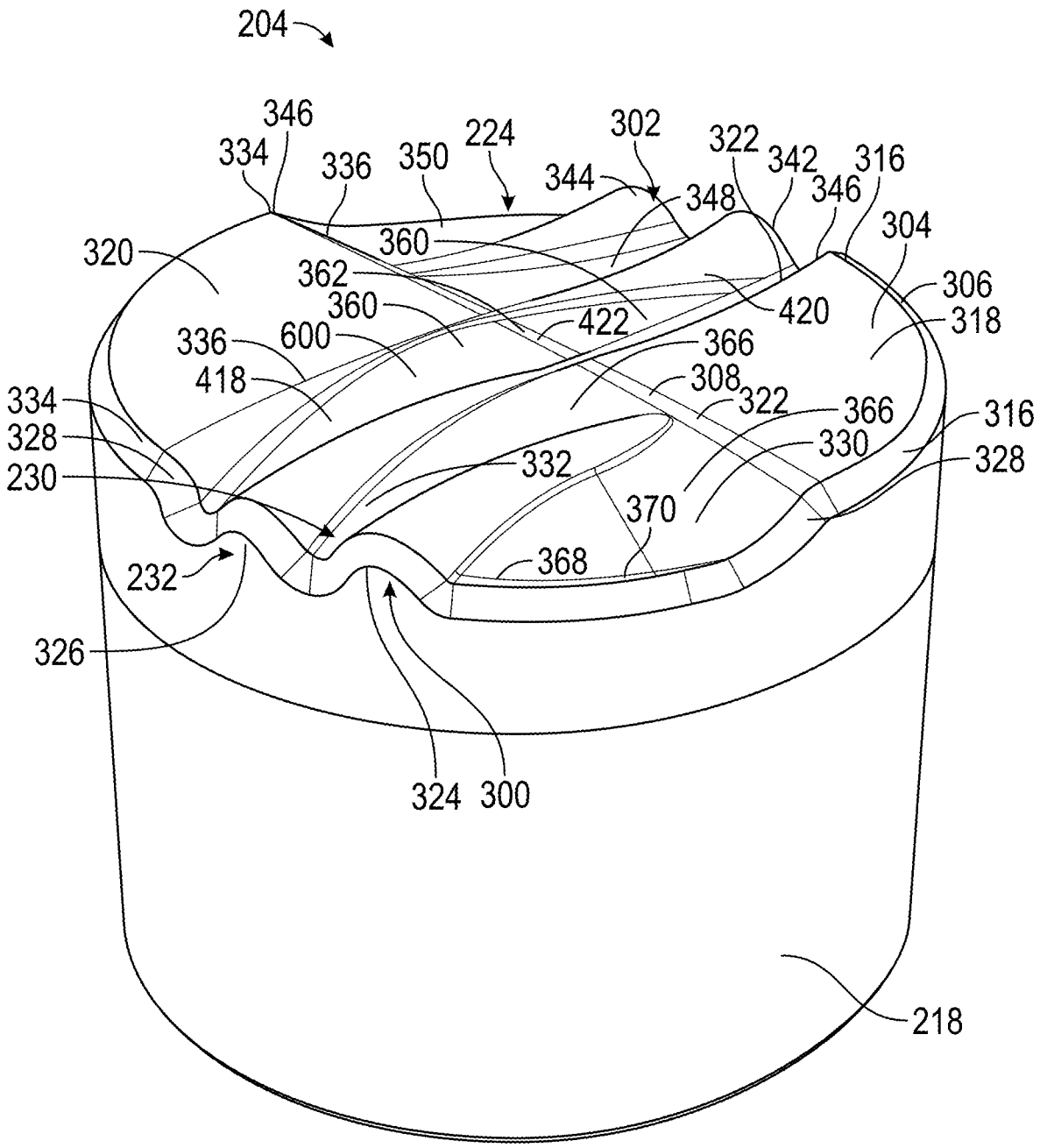
FIG. 6 illustrates a perspective view of a cutting element having a central channel with a convex portion, in accordance with some embodiments of the present disclosure.

FIG. 6 illustrates a perspective view of a cutting element having a central channel with a convex bottom portion, in accordance with some embodiments of the present disclosure. As set forth above, the cutting face 224 of the cutting element 204 may include the plurality of ridges 232 with the at least one channel 230 formed between adjacent ridges 232 and/or axial edge surfaces 304 of the cutting face 224. For example, as illustrated, the cutting face 224 may include the first axial edge surface 318 extending circumferentially along the first portion 316 of the periphery 306 of the cutting face 224 and extending radially inward from the first portion 316 of the periphery 306 to the first radially inner side 322 of the first axial edge surface 318. The first radially inner side 322 may include all radially inner edges of the first axial edge surface 318. Further, as set forth above, the cutting face 224 may include the first group of ridges 300 (e.g., the first ridge 324 and the second ridge 326) extending along curved paths across the cutting face 224 from the second portion 328 of the periphery 306 to the first radially inner side 322 of the first axial edge surface 318.

Moreover, the second axial edge surface 320 of the cutting face 224 may extend circumferentially along the third portion 334 of the periphery 306 of the cutting face 224 and extend radially inward from the third portion 334 of the periphery 306 to the second radially inner side 336 of the second axial edge surface 320. The second group of ridges 302 (e.g., the third ridge 342 and the fourth ridge 344) may each extend along curved paths across the cutting face 224 from the fourth portion 346 of the periphery 306 to the second radially inner side 336 of the second axial edge surface 320.

The at least one channel 230 (e.g., the first channel 330, the second channel 332, the third channel 348, and/or the fourth channel 350) may include the tapered section 366 that extends from an initial point 368 along the length of the at least one channel 230 to the radially inner side 308 of the at least one axial edge surface 304. The initial point 368 may be at a transition between a main portion 370 of the at least one channel 230 and the tapered section 366 of the at least one channel 230. The main portion 370 may be flat with respect to the substrate 218. As illustrated, the initial point 368 may be disposed proximate the periphery 306 such that the tapered section 366 extends across a majority of the at least one channel 230. Alternatively, the tapered section 366 may extend directly to the periphery 306. Moreover, as illustrated, the tapered section 366 may extend non-linearly from the initial point 368 to the radially inner side 308 of the at least one axial edge surface 304. For example, the tapered section 366 may include a generally convex shape with respect to the substrate 218. Alternatively, the tapered section 366 may extend linearly from the initial point 368 to the radially inner side 308 of the at least one axial edge surface 304.

The central channel 360 may be formed between the second ridge 326 and the third ridge 342, and extend across the cutting face 224 from the second portion 328 of the periphery 306 to the fourth portion 346 of the periphery 306. As set forth above, the central channel 360 may be curved in a first direction along a first length 418 of the central channel 360 and curved in a second direction along a second length 420 of the central channel 360. That is, the central channel 360 may have an inflection point 422 proximate the center 362 of the cutting face 224. Alternatively, the central channel 360 may include additional inflection points or no inflection points.

Further, the central channel 360 may have a variable depth across the length of the central channel 360. That is, the depth of the of the central channel 360 may increase and/or decrease along the length of the central channel 360. In particular, a bottom portion 600 of the central channel 360 may include a generally convex shape. That is, the depth of the central channel 360 may gradually increase as the central channel 360 approaches the periphery 306. Indeed, the bottom portion 600 of the central channel 360 proximate the center 362 of the cutting face 224 may extend axially outward, with respect to the substrate 218, further than other portions of the central channel 360. The bottom portion 600 of the central channel 360 may be curved axially downward toward the substrate 218 as the central channel 360 extends from the center 362 of the cutting face radially toward each of the second portion 328 of the periphery 306 and the fourth portion 346 of the periphery 306 such that the bottom portion 600 of the central channel 360 has the generally convex shape.

Accordingly, the present disclosure may provide cutting elements with various ridges and channels that extend to respective axial edge surfaces, which may disrupt or suppress fracture paths for the various ridges. The systems and methods may include any of the various features disclosed herein, including one or more of the following statements.

Statement 1. A cutting element, comprising: a substrate securable within a pocket formed in a bit body of a drill bit; and a cutting portion securable to the substrate, wherein the cutting portion comprises a cutting face configured to engage a subterranean formation, wherein the cutting face comprises: at least one axial edge surface extending circumferentially along at least a first portion of a periphery of the cutting face and extending radially inward from the periphery; a plurality of ridges, wherein at least one ridge of the plurality of ridges extends from a second portion of the periphery of the cutting face to a radially inner side of the at least one axial edge surface; and at least one channel formed between adjacent ridges of the plurality of ridges, wherein the at least one channel is configured to direct formation cuttings along a path of the at least one channel.

Statement 2. The cutting element of statement 1, wherein the at least one channel comprises a variable depth along a length of the at least one channel.

Statement 3. The cutting element of statement 1 or statement 2, wherein the at least one channel comprises a tapered section extending from an initial point along a length of the at least one channel to the at least one axial edge surface.

Statement 4. The cutting element of any preceding statement, wherein a depth of the tapered section reduces in a direction from the initial point toward the at least one axial edge surface.

Statement 5. The cutting element of any preceding statement, wherein a depth of the tapered section reduces linearly from the initial point toward the at least one axial edge surface.

Statement 6. The cutting element of any of statements 1-4, wherein a depth of the tapered section reduces non-linearly from the initial point toward the at least one axial edge surface.

Statement 7. The cutting element of any preceding statement, wherein at least one ridge of the plurality of ridges comprises an inner ridge side and an outer ridge side, wherein the inner ridge side extends across the cutting face from the second portion of the periphery toward another portion of the periphery, and wherein the outer ridge side extends from the second portion of the periphery to a tapered section of the at least one channel.

Statement 8. The cutting element of any preceding statement, wherein the at least one ridge of the plurality of ridges extends across the cutting face along a curved path.

Statement 9. The cutting element of any preceding statement, wherein the at least one ridge of the plurality of ridges includes a variable width along a height of the at least one ridge.

Statement 10. The cutting element of any preceding statement, wherein the at least one axial edge surface includes a uniform radial width portion and a non-uniform radial width portion, wherein the uniform radial width portion extends radially inward from the periphery to a parallel portion of the radially inner side of the at least one axial edge surface, wherein the parallel portion is parallel to the first portion of the periphery and wherein the at least one ridge of the plurality of ridges extends from the second portion of the periphery to the parallel portion of the radially inner side of the at least one axial edge surface.

Statement 11. The cutting element of any preceding statement, wherein the at least one axial edge surface includes a first axial edge surface and a second axial edge surface, wherein the first axial edge surface extends circumferentially along the first portion of the periphery of the cutting face, wherein the second axial edge surface extends circumferentially along a third portion of the periphery of the cutting face, and wherein the second portion of the periphery extends between a first circumferential end of the first axial edge surface and a second circumferential end of the second axial edge surface, and wherein a fourth portion of the periphery extends between a third circumferential end of the first axial edge surface and a fourth circumferential end of the second axial edge surface.

Statement 12. The cutting element of any preceding statement, wherein the plurality of ridges includes a first group of ridges disposed on a first side of the cutting face and a second group of ridges disposed on a second side of the cutting face, wherein each ridge of the first group of ridges extends from the second portion of the periphery to a first radially inner side of the first axial edge surface, and wherein each ridge of the second group of ridges extends from the fourth portion of the periphery to a second radially inner side of the second axial edge surface.

Statement 13. The cutting element of any preceding statement, wherein ridges of the first group of ridges are parallel with each other, wherein ridges of the second group of ridges are parallel with each other, and wherein the first group of ridges are nonparallel with the second group of ridges.

Statement 14. The cutting element of any preceding statement, further comprising a central channel formed between the first group of ridges and the second group of ridges, wherein the central channel includes a variable central channel width that decreases in a radially inward direction with respect to the periphery of the cutting face.

Statement 15. The cutting element of any of statements 1-13, further comprising a central channel formed between the first group of ridges and the second group of ridges, wherein the central channel includes a uniform central channel width along a length of the central channel.

Statement 16. The cutting element of any preceding statement, further comprising a central channel formed between the first group of ridges and the second group of ridges, wherein the central channel includes a variable depth along a length of the central channel.

Statement 17. A cutting element, comprising: a substrate securable within a pocket formed in a bit body of a drill bit; and a cutting portion securable to the substrate, wherein the cutting portion comprises a cutting face configured to engage a downhole formation, wherein the cutting face comprises: a first axial edge surface extending circumferentially along a first portion of a periphery of the cutting face and extending radially inward from the first portion of the periphery; a first group of ridges including a first ridge and a second ridge, wherein the first ridge and the second ridge each extend from a second portion of the periphery to a first radially inner side of the first axial edge surface; a first channel formed between the first ridge and the first radially inner side of the first axial edge surface; a second channel formed between the first ridge and the second ridge; a second axial edge surface extending circumferentially along a third portion of the periphery of the cutting face and extending radially inward from the third portion of the periphery; a second group of ridges including a third ridge and a fourth ridge, wherein the third ridge and the fourth ridge each extend from a fourth portion of the periphery to a second radially inner side of the second axial edge surface; a third channel formed between the third ridge and the fourth ridge; a fourth channel formed between the fourth ridge and the second radially inner side of the second axial edge surface; and a central channel formed between the first group of ridges and the second group of ridges.

Statement 18. The cutting element of statement 17, wherein the first channel and the second channel include a first tapered section and a second tapered section, respectively, extending from respective initial points along corresponding lengths of the first channel and the second channel to the first radially inner side of the first axial edge surface, and wherein the third channel and the fourth channel include a third tapered section and a fourth tapered section, respectively, extending from respective initial points along the corresponding lengths of the third channel and the fourth channel to the second radially inner side of the second axial edge surface.

Statement 19. The cutting element of statement 17 or statement 18, wherein respective peaks of the first ridge, the second ridge, the third ridge and the fourth ridge are axially aligned with the first axial edge surface and the second axial edge surface.

Statement 20. A drill bit comprising: a bit body; one or more blades attached to the bit body; one or more pockets formed in the one or more blades; and one or more cutting elements fixed in the one or more pockets, wherein each cutting element of the one or more cutting elements comprises a respective cutting face configured to engage a downhole formation, wherein each cutting face comprises: at least one axial edge surface extending circumferentially along at least a portion of a periphery of the cutting face and extending radially inward from the periphery; a plurality of ridges, wherein at least one ridge of the plurality of ridges extends from a respective portion of the periphery to a radially inner side of the at least one axial edge surface; and at least one channel formed between adjacent ridges of the plurality of ridges, wherein the at least one channel is configured to direct formation cuttings along a path of the at least one channel.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A cutting element, comprising:

a substrate securable within a pocket formed in a bit body of a drill bit; and a cutting portion securable to the substrate, wherein the cutting portion comprises a cutting face configured to engage a subterranean formation, wherein the cutting face comprises:

at least one axial edge surface extending circumferentially along at least a first portion of a periphery of the cutting face and extending radially inward from the periphery;

a plurality of ridges, wherein at least one ridge of the plurality of ridges extends from a second portion of the periphery of the cutting face to a radially inner side of the at least one axial edge surface, wherein each ridge of the plurality of ridges includes a ridge peak extending along the length of the ridge, and wherein respective ridge peaks of the plurality of ridges are axially aligned with the at least one axial edge surface; and at least one channel formed between adjacent ridges of the plurality of ridges, wherein the at least one channel is configured to direct formation cuttings along a path of the at least one channel.

2. The cutting element of claim 1, wherein the at least one channel comprises a variable depth along a length of the at least one channel.

3. The cutting element of claim 1, wherein the at least one channel comprises a tapered section extending from an initial point along a length of the at least one channel to the at least one axial edge surface.

4. The cutting element of claim 3, wherein a depth of the tapered section reduces in a direction from the initial point toward the at least one axial edge surface.

5. The cutting element of claim 3, wherein a depth of the tapered section reduces linearly from the initial point toward the at least one axial edge surface.

6. The cutting element of claim 3, wherein a depth of the tapered section reduces non-linearly from the initial point toward the at least one axial edge surface.

7. The cutting element of claim 1, wherein at least one ridge of the plurality of ridges comprises an inner ridge side and an outer ridge side, wherein the inner ridge side extends across the cutting face from the second portion of the periphery toward another portion of the periphery, and wherein the outer ridge side extends from the second portion of the periphery to a tapered section of the at least one channel.

8. The cutting element of claim 1, wherein the at least one ridge of the plurality of ridges extends across the cutting face along a curved path.

9. The cutting element of claim 1, wherein the at least one ridge of the plurality of ridges includes a variable width along a height of the at least one ridge.

10. The cutting element of claim 1, wherein the at least one axial edge surface includes a uniform radial width portion and a non-uniform radial width portion, wherein the uniform radial width portion extends radially inward from the periphery to a parallel portion of the radially inner side of the at least one axial edge surface, wherein the parallel portion is parallel to the first portion of the periphery and wherein the at least one ridge of the plurality of ridges extends from the second portion of the periphery to the parallel portion of the radially inner side of the at least one axial edge surface.

11. The cutting element of claim 1, wherein the at least one axial edge surface includes a first axial edge surface and a second axial edge surface, wherein the first axial edge surface extends circumferentially along the first portion of the periphery of the cutting face, wherein the second axial edge surface extends circumferentially along a third portion of the periphery of the cutting face, and wherein the second portion of the periphery extends between a first circumferential end of the first axial edge surface and a second circumferential end of the second axial edge surface, and wherein a fourth portion of the periphery extends between a third circumferential end of the first axial edge surface and a fourth circumferential end of the second axial edge surface.

12. The cutting element of claim 11, wherein the plurality of ridges includes a first group of ridges disposed on a first side of the cutting face and a second group of ridges disposed on a second side of the cutting face, wherein each ridge of the first group of ridges extends from the second portion of the periphery to a first radially inner side of the first axial edge surface, and wherein each ridge of the second group of ridges extends from the fourth portion of the periphery to a second radially inner side of the second axial edge surface.

13. The cutting element of claim 12, wherein ridges of the first group of ridges are parallel with each other, wherein ridges of the second group of ridges are parallel with each other, and wherein the first group of ridges are nonparallel with the second group of ridges.

14. The cutting element of claim 12, further comprising a central channel formed between the first group of ridges and the second group of ridges, wherein the central channel includes a variable central channel width that decreases in a radially inward direction with respect to the periphery of the cutting face.

15. The cutting element of claim 12, further comprising a central channel formed between the first group of ridges and the second group of ridges, wherein the central channel includes a uniform central channel width along a length of the central channel.

16. The cutting element of claim 12, further comprising a central channel formed between the first group of ridges and the second group of ridges, wherein the central channel includes a variable depth along a length of the central channel.

17. A cutting element, comprising:

a substrate securable within a pocket formed in a bit body of a drill bit; and a cutting portion securable to the substrate, wherein the cutting portion comprises a cutting face configured to engage a downhole formation, wherein the cutting face comprises:

a first axial edge surface extending circumferentially along a first portion of a periphery of the cutting face and extending radially inward from the first portion of the periphery;

a first group of ridges including a first ridge and a second ridge, wherein the first ridge and the second ridge each extend from a second portion of the periphery to a first radially inner side of the first axial edge surface;

a first channel formed between the first ridge and the first radially inner side of the first axial edge surface;

a second channel formed between the first ridge and the second ridge;

a second axial edge surface extending circumferentially along a third portion of the periphery of the cutting face and extending radially inward from the third portion of the periphery;

a second group of ridges including a third ridge and a fourth ridge, wherein the third ridge and the fourth ridge each extend from a fourth portion of the periphery to a second radially inner side of the second axial edge surface;

a third channel formed between the third ridge and the fourth ridge;

a fourth channel formed between the fourth ridge and the second radially inner side of the second axial edge surface; and a central channel formed between the first group of ridges and the second group of ridges.

18. The cutting element of claim 17, wherein the first channel and the second channel include a first tapered section and a second tapered section, respectively, extending from respective initial points along corresponding lengths of the first channel and the second channel to the first radially inner side of the first axial edge surface, and wherein the third channel and the fourth channel include a third tapered section and a fourth tapered section, respectively, extending from respective initial points along the corresponding lengths of the third channel and the fourth channel to the second radially inner side of the second axial edge surface.

19. The cutting element of claim 17, wherein respective peaks of the first ridge, the second ridge, the third ridge and the fourth ridge are axially aligned with the first axial edge surface and the second axial edge surface.

20. A drill bit comprising:

a bit body;

one or more blades attached to the bit body;

one or more pockets formed in the one or more blades; and one or more cutting elements fixed in the one or more pockets, wherein each cutting element of the one or more cutting elements comprises a respective cutting face configured to engage a downhole formation, wherein each cutting face comprises:

at least one axial edge surface extending circumferentially along at least a portion of a periphery of the cutting face and extending radially inward from the periphery;

a plurality of ridges, wherein at least one ridge of the plurality of ridges extends from a respective portion of the periphery to a radially inner side of the at least one axial edge surface, wherein each ridge of the plurality of ridges includes a ridge peak extending along the length of the ridge, and wherein respective ridge peaks of the plurality of ridges are axially aligned with the at least one axial edge surface; and at least one channel formed between adjacent ridges of the plurality of ridges, wherein the at least one channel is configured to direct formation cuttings along a path of the at least one channel.

* * * * *